US010357681B2

(12) United States Patent
Davison

(10) Patent No.: US 10,357,681 B2
(45) Date of Patent: Jul. 23, 2019

(54) ZERO G INERTIA EXERCISE APPARATUS

(71) Applicant: Steve W Davison, Newnan, GA (US)

(72) Inventor: Steve W Davison, Newnan, GA (US)

( * ) Notice: Subject to any disclaimer, the term of this patent is extended or adjusted under 35 U.S.C. 154(b) by 0 days.

(21) Appl. No.: 15/975,709

(22) Filed: May 9, 2018

(65) Prior Publication Data

US 2019/0009126 A1 Jan. 10, 2019

Related U.S. Application Data

(60) Provisional application No. 62/528,851, filed on Jul. 5, 2017.

(51) Int. Cl.
*A63B 21/00* (2006.01)
*A63B 21/16* (2006.01)
(Continued)

(52) U.S. Cl.
CPC ..... *A63B 21/154* (2013.01); *A63B 21/00061* (2013.01); *A63B 21/062* (2013.01); *A63B 21/16* (2013.01); *A63B 21/22* (2013.01)

(58) Field of Classification Search
CPC ..... A63B 21/00058; A63B 21/00061; A63B 21/00065; A63B 21/00076; A63B 21/00178; A63B 21/00181; A63B 21/00185; A63B 21/00196; A63B 21/002; A63B 21/0023; A63B 21/0618; A63B 21/062; A63B 21/0624; A63B 21/0626; A63B 21/0628; A63B 21/063; A63B 21/0632; A63B 21/08; A63B 21/15; A63B 21/151; A63B 21/152; A63B 21/154; A63B 21/155; A63B 21/156; A63B 21/16; A63B 21/4027; A63B 21/4029; A63B 21/4031; A63B 21/4045; A63B 21/4047; A63B 21/4049; A63B 22/0046; A63B 22/0076; A63B 22/0087; A63B 22/0089; A63B 2022/0079; A63B 69/06; A63B 2069/062;
(Continued)

(56) References Cited

U.S. PATENT DOCUMENTS 2,087,709 A 7/1937 Van Guilder
4,632,392 A 12/1986 Peyton et al.
(Continued)

FOREIGN PATENT DOCUMENTS

CN 1428507 A 7/2003

OTHER PUBLICATIONS

International Search Report and Written Opinion dated Aug. 2, 2018 in related International Application No. PCT/US18/31915, filed May 9, 2018.

*Primary Examiner* — Gary D Urbiel Goldner
(74) *Attorney, Agent, or Firm* — Wiley Rein LLP

(57) ABSTRACT

An exerciser includes a frame, a movable platform disposed on the frame, the movable platform being movable between a first position and a second position, at least one weight disposable on the moveable platform in a first orientation so that the at least one weight slides between a third position and a fourth position, and a tether connected to the moveable platform to move the moveable platform from the first position to the second position. The at least one weight slides to the third position when the movable platform reaches the first position. The at least one weight slides to the fourth position when the moveable platform reaches the second position.

19 Claims, 15 Drawing Sheets

(51) Int. Cl.
*A63B 21/22* (2006.01)
*A63B 21/062* (2006.01)

(58) Field of Classification Search
CPC ..... A63B 71/0054; A63B 2071/0063; A63B 2071/0072; A63B 2071/0081; A63B 2220/50; A63B 2220/51; A63B 2220/52; A63B 2220/53; A63B 2225/09; A63B 2225/093
See application file for complete search history.

(56) References Cited

U.S. PATENT DOCUMENTS 4,728,099 A 3/1988 Pitre
4,907,797 A * 3/1990 Gezari ..... A63B 21/0058 482/135
7,976,439 B2 * 7/2011 Abelbeck ..... A63B 21/00072 482/92
9,895,567 B2 * 2/2018 Lee ..... A63B 21/008
2005/0153797 A1 * 7/2005 Nutter ..... A63B 15/005 473/457
2005/0274197 A1 12/2005 Le
2006/0223681 A1 * 10/2006 Loane ..... A63B 22/16 482/71
2007/0129222 A1 * 6/2007 Kolomeir ..... A63B 21/00069 482/112
2007/0129223 A1 * 6/2007 Kolomeir ..... A63B 21/00072 482/112
2007/0142187 A1 * 6/2007 Kolomeir ..... A63B 21/4047 482/92
2007/0238583 A1 * 10/2007 Cunningham ... A63B 23/03541 482/52
2009/0156362 A1 6/2009 Berg
2011/0218081 A1 9/2011 Uygan
2015/0367162 A1 * 12/2015 Mueller ..... A63B 21/0058 482/94
2016/0121156 A1 * 5/2016 Bach ..... A63B 21/0087 482/112
2017/0319905 A1 * 11/2017 O'Connor ..... A63B 24/0087

* cited by examiner

ZERO G INERTIA EXERCISE APPARATUS

CROSS-REFERENCE TO RELATED. APPLICATION(S)

This Non-Provisional U.S. Patent Application relies for priority on U.S. Provisional Patent Application 62/528,851, filed on Jul. 5, 2017, the entire contents of which are incorporated herein by reference.

FIELD OF THE INVENTION

The present invention concerns an exercise apparatus and method that, inter alia, stimulates bone growth and development.

DESCRIPTION OF THE RELATED ART

As should be apparent to those familiar with the effects of micro-gravity on human physiology, when humans spend extended time periods in space (i.e., in micro-gravity or zero gravity environments), humans lose both muscle and bone mass, because the body adjusts to the micro-gravity or zero gravity environment.

While exercise can help to maintain muscle mass in a microgravity or zero gravity environment, exercise to maintain muscle mass in such an environment is ineffective in developing and/or maintaining bone mass in the same environment.

As a result, a need has arisen for ways to maintain bone mass in a micro-gravity or zero gravity environment.

SUMMARY OF THE INVENTION

Impulse Training ("IT") is a neuromuscular development tool that may be employed in micro-gravity and/or zero gravity environments to stimulate bone development and, therefore, to eliminate and/or reduce loss of bone mass when humans spend extended periods of time in microgravity or zero gravity environments.

While the present invention is described in connection with the term Impulse Training, the present invention should not be considered to be limited by the use of this term.

Impulse Training concerns developing a person's neural systems capacity to generate impulses. IT is an excellent tool that has been used over the years to rehabilitate patients with one or more musculoskeletal injuries.

Over the years, IT has become a significant rehabilitation, injury prevention, and performance enhancement tool in professional sports.

By way of background, two summaries of studies using of IT in professional sports are appended to this disclosure. The summaries and the articles cited therein are incorporated into this disclosure by reference in their entireties.

The present invention seeks to address the deficiencies associated with the prior art.

In particular, the present invention provides an exerciser that includes a frame, a movable platform disposed on the frame, the movable platform being movable between a first position and a second position, at least one weight disposable on the moveable platform in a first orientation so that the at least one weight slides between a third position and a fourth position, and a tether connected to the moveable platform to move the moveable platform from the first position to the second position. The at least one weight slides to the third position when the movable platform reaches the first position. The at least one weight slides to the fourth position when the moveable platform reaches the second position.

In one contemplated embodiment, the exerciser also includes at least one stop disposed on the movable platform. The at least one weight slidably engages the at least one stop at the third position and the fourth position.

In another contemplated embodiment, the at least one movable weight generates an energy spike at the third position and at the fourth position.

The at least one weight also may be disposable on the movable platform in a second orientation so that the at least one weight remains unmovably fixed on the movable platform.

It is contemplated that the exerciser may include a tether length adjustment mechanism permitting adjustment of the length of the tether.

Where a tether length adjustment mechanism is included, the tether length adjustment mechanism may include at least one tether collection tab, facilitating shortening of the tether, and at least one tether cinch tab, permitting securement of the tether in a shortened condition.

It is also contemplated that the exerciser may include a plurality of guide pulleys positioned adjacent to the movable platform to direct the tether to the movable position.

In a contemplated embodiment, the exerciser may include a force sensor transducer connected to at least one of the plurality of pulleys to generate data concerning the force applied to the tether.

In one contemplated embodiment, the movable platform is a rotary platform.

The rotary platform may include a circular plate, and a groove defined at the perimeter of the circular plate. The tether is contemplated to engage the groove.

It is contemplated that the rotary platform may include at least one stop disposed on a top surface of the circular plate and a broad notch in the at least one weight defining first and second edges. The first and second edges engage the at least one stop at the third position and the fourth position.

The at least one movable weight is contemplated to generate energy spikes at the third position and at the fourth position.

The at least one weight may be disposable atop the circular plate in a second orientation so that the at least one weight remains unmovably fixed on the circular plate.

In another contemplated embodiment, the movable platform is a linear platform.

Where the movable platform is a linear platform, the linear platform is contemplated to include a top and first and second sides and a primary pulley secured between the first and second sides. The tether engages the primary pulley.

For the embodiment including the linear platform, the exerciser may include at least one stop disposed on each of the first and second sides and at least one slot in the at least one weight defining first and second ends. The first and second ends engage the at least one stop at the third position and the fourth position.

The at least one movable weight generates energy spikes at the third position and at the fourth position.

The at least one weight is disposable on one of the sides so that the at least one weight remains unmovably fixed on the linear platform.

The exerciser also may include a vertical pulley frame element and a repositionable pulley disposed on the vertical pulley frame element. The tether engages the repositionable pulley.

Still further aspects of the present invention will be made apparent from the drawings and the discussion provided below.

BRIEF DESCRIPTION OF THE DRAWINGS

The drawings illustrate various, non-limiting embodiments of the present invention, in which.

DESCRIPTION OF EMBODIMENTS OF THE INVENTION

Figure 1:
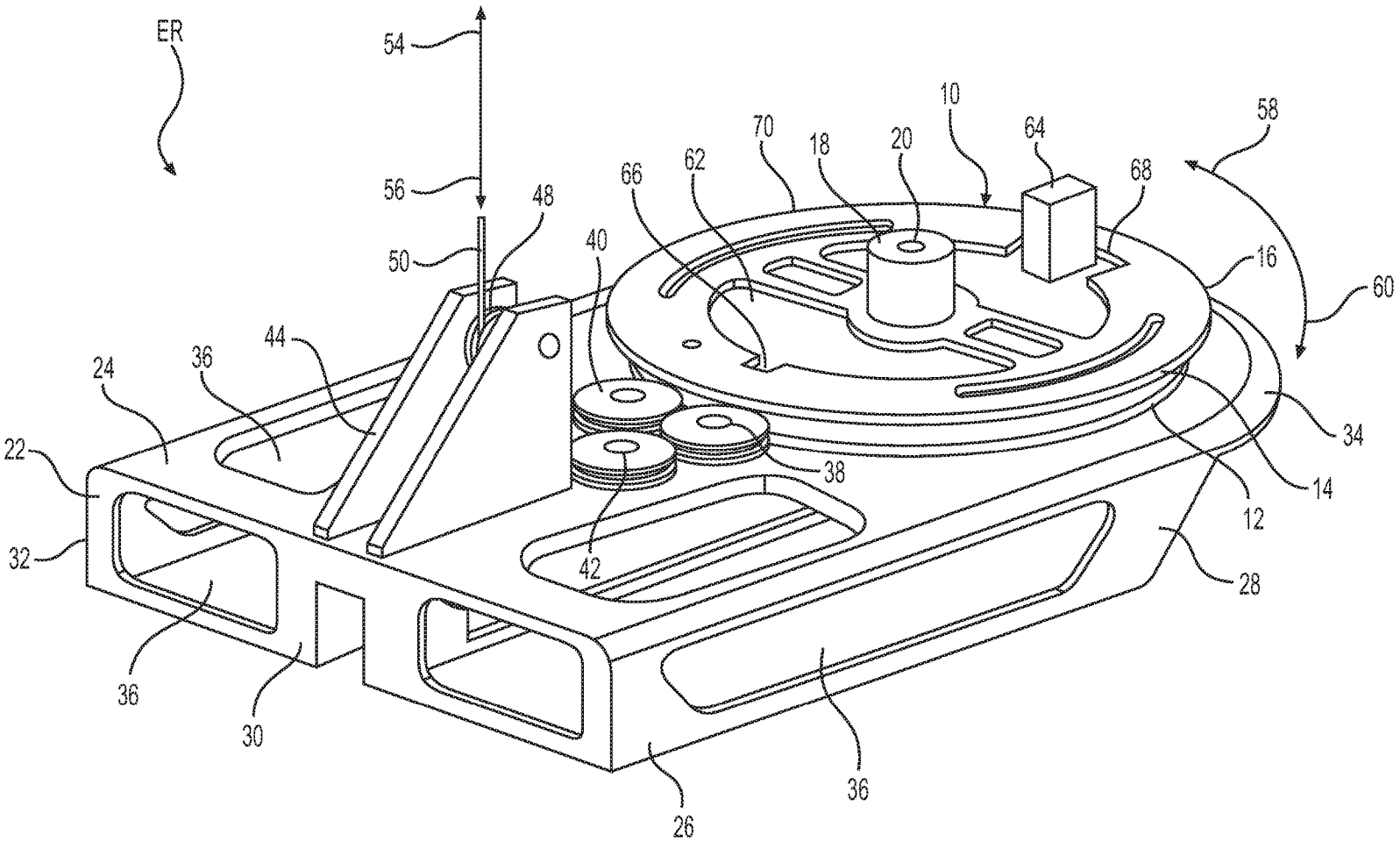
FIG. 1 is a perspective illustration of a first embodiment of an exerciser incorporating a rotary platform for its operation.

The present invention will now be described in connection with one or more embodiments. The discussion of the embodiments is intended to highlight the breadth and scope of the present invention without limiting the invention thereto. Those skilled in the art should appreciate that the present invention may be implemented via one or more equivalents and variations of the embodiments described herein. Those equivalents and variations are intended to be encompassed by the present invention.

For purposes of the discussion that follows, the term "zero gravity" will be used to refer to environments with micro-gravity and/or zero gravity.

While the present invention is contemplated to be employed in zero gravity environments, it is noted that the techniques described herein may be employed in any low gravity environment. A low gravity environment is one that is at less than standard earth gravity (or 1 g).

Still further, the techniques described herein may be employed in a standard gravity environment, such as would be expected for physical therapy and physical development.

In addition, the present invention will be described in connection with specific dimensions. Those dimensions are merely exemplary and should not be understood to limit the invention in any fashion.

The Invention, Generally

According to a general blueprint for the present invention, an exercise device ER, EL uses inertia as a resistive medium while providing concentric and eccentric muscle contractions producing an acceleration and deceleration of a movable platform.

As illustrated in the figures, and as discussed in the paragraphs that follow, the exerciser ER, EL of the present invention encompasses and/or incorporates a lightweight movable platform 10, 110, which is designed to accommodate the addition of multiple weights 70, 128 to increase the mass of the movable platform 10, 110 and, thereby, to increase the inertial resistance provided by the movable platform 10, 110.

As also will be made apparent from the discussion that follows, the weights 70, 128 may be positioned on the movable platform 10, 110 in a manner that causes an instantaneous force spike during exercise. Among other aspects, it is believed that the instantaneous force spike contributes to the development and/or retention of bone mass.

As highlighted, the exerciser ER, EL of the present invention encompasses two basic, non-limiting examples of embodiments. The first embodiment of the exerciser ER incorporates a rotary platform 10. The second embodiment of the exerciser EL encompasses a linear platform 110.

The exerciser ER, EL of the present invention, whether incorporating a platform that is rotary or linear, is put into motion by a tether 50 attached to the platform at one end of the tether 50. The other end of the tether 50 connects to a handle or strap to for interaction with a human engaged in exercise. By pulling on the tether 50 by any suitable body part, the user interacts with the platform 10, 110, thereby engaging in the exercise beneficial to bone mass growth.

In one or more contemplated embodiments, the tether 50 is contemplated to be threaded through a series of low friction guide pulleys. The pulleys are positioned relative to movable platform 10, 110 so that the direction of the tether 50 is reversed as a predetermined point on the movable platform 10, 110 passes the pulleys. As discussed in the paragraphs that follow, this motion results in the creation and imposition of instantaneous force spikes on the tether 50, which are transmitted, via the tether 50, to the user.

As noted above, there are at least two general concepts for the movable platform of the exerciser ER, EL: (1) a rotary platform 10, and (2) a linear platform 110. Both embodiments generate instantaneous force spikes by permitting the associated weights 70, 128 to slide relative to the platforms 10, 110 after the platforms 10, 110 reach their maximum travel locations. The term "maximum travel location(s)" is intended to be an adjustable, user-defined parameter. Accordingly, the term "maximum travel location" and its equivalents should not be understood to refer to a total travel distance that may be traversed by the platforms 10, 110 for a particular configuration of the exerciser ER, EL.

In each embodiment, the movable platforms 10, 110 are permitted to travel from a first position to a second position. The first and second positions are the maximum travel locations of the movable platforms 10, 110, as defined by the user for a particular exercise regimen. In a first orientation, the weights 70, 128 are attached to the movable platforms 10, 110 to move, with respect to the movable platforms 10, 110, between a third position and a fourth position. Specifically, due to inertia, the weights 70, 128 slide relative to the movable platforms 10, 110 between the third and fourth positions when the movable platforms 10, 110 reach the first and second positions. The sliding of the weights 70, 128 creates the instantaneous force spikes that contribute to bone mass growth and/or retention.

The two general embodiments of the present invention are discussed with specific detail in the paragraphs that follow. The first embodiment is referred to as an exerciser ER, because this embodiment relies on rotary motion for its operation. The second embodiment is referred to as an exerciser EL, because this embodiment relies on linear motion for its operation.

The First Embodiment: The Rotary Platform

The first embodiment of a movable platform of the exerciser ER is illustrated in FIGS. 1-7.

In this first embodiment, the movable platform relies on rotary motion to generate the instantaneous force spikes. Accordingly, for this first embodiment, the movable platform is referred to as a rotary platform 10.

The rotary platform 10 encompasses a circular plate 12 with a peripheral groove 14 around its perimeter 16. The rotary platform 10 includes a hub 18 at its center. In the illustrated embodiment, the hub 18 is integrally formed with the circular plate 12. As such, the hub 18 is contemplated to rotate around a shaft 20 at the center of the hub 18. The shaft 20 is attached to a frame 22 that supports the rotary platform 10.

It is noted that the rotary platform 10 is not intended to be limited solely to the construction depicted. To the contrary, the rotary platform 10 may be constructed in any alternative manner as may be apparent to those skilled in the art. For example, in one variation, the hub 18 may include a bearing or bushing disposed around the shaft 20. In a further variation, the hub 18 may be replaced by a bearing or bushing that is fixed to the frame 22 without a shaft 20.

The rotary platform 10 may be constructed from any suitable material. Examples of suitable materials include, but are not limited to, lightweight materials, aluminum, aluminum alloys, magnesium, magnesium alloys, beryllium, beryllium alloys, titanium, titanium alloys, ceramics, composite materials, carbon fiber composites, plastics, and the like. Heavier materials also may be employed such as iron, alloys of iron, steel, brass, etc., as should be apparent to those skilled in the art.

In the illustrated embodiment, the frame 22 defines a top surface 24, a bottom surface 26, a first side surface 28, a second side surface 30, a third side surface 32, and a fourth side surface 34. The frame 22 is essentially a rectangularly-shaped structure where the fourth side surface 34 is curved. In this embodiment, the fourth side surface 34 defines an arc that mirrors the curvature of the perimeter 16 of the circular plate 12. As should be apparent to those skilled in the art, this shape is not required. The frame 22 may have any suitable shape without departing from the scope of the present invention.

Regardless of the shape of the frame 22, it is contemplated that the frame 22 will be constructed to be light in weight. Accordingly, as illustrated, the frame 22 incorporates a plurality of holes 36 to reduce the weight of the frame 22 without sacrificing the strength of the frame 22. As should be apparent to those skilled in the art, the holes 36 may take any shape and be located at any position in the frame 22 without departing from the scope of the present invention.

The frame 22 may be made from any suitable material. Examples of suitable materials include, but are not limited to, lightweight materials, aluminum, aluminum alloys, magnesium, magnesium alloys, beryllium, beryllium alloys, titanium, titanium alloys, ceramics, composite materials, carbon fiber composites, plastics, and the like. Heavier materials also may be employed such as iron, alloys of iron, steel, brass, etc., as should be apparent to those skilled in the art.

As also illustrated in FIG. 1, a first guide pulley 38, a second guide pulley 40, and a third guide pulley 42 are rotatably mounted to the top surface 24 of the frame 22. The frame 22 also includes a protrusion 44 that extends outwardly from the top surface 24. A fifth guide pulley 46 and a sixth guide pulley 48 (see FIGS. 4 and 5) are located in the protrusion 44.

Each of the guide pulleys 38, 40, 42, 46, 48 may be constructed from any suitable material. Examples of suitable materials include, but are not limited to, lightweight materials, aluminum, aluminum alloys, magnesium, magnesium alloys, beryllium, beryllium alloys, titanium, titanium alloys, ceramics, composite materials, carbon fiber composites, plastics, and the like. Heavier materials also may be employed such as iron, alloys of iron, steel, brass, etc., as should be apparent to those skilled in the art.

A tether 50 extends through the protrusion 44. The tether 50 is threaded around the guide pulleys 38, 40, 42, 46, 48, which redirect the tether 50 from a direction normal to the top surface 24 of the frame 22 to a direction parallel to the top surface 24 of the frame 22. The tether 50 engages the circular plate 12 at an engagement point 52, wraps around the perimeter 16 of the circular plate 12, and is captured by the groove 14 at the perimeter 16 of the circular plate 12.

As discussed in greater detail in the paragraphs that follow, at a point exterior to the protrusion 44, the tether 50 moves in the direction of the arrows 54, 56. Since the tether 50 is connected to the circular plate 12, as the tether 28 moves in the directions of the arrows 54, 56, the rotary platform 10 moves in the directions of the arrows 58, 60.

The exerciser ER and its rotary platform 10 are contemplated to be mounted vertically. However, as should be apparent to those skilled in the art, in a zero-gravity environment, the orientation of the exerciser ER is not relevant to the operation of the exerciser ER.

The circular plate 12 defines a top surface 62. A stop 64 (also referred to as a raised notch 64) extends upwardly from the top surface 62. The stop 64 may be engaged by either a narrow notch 66 or a broad notch 68 in one or more of the weights 70 that are removably disposable on the circular plate 12.

Each weight 70 is contemplated to be identical in construction to each other weight 70. However, it is not necessary for each weight 70 to be structurally identical to each other weight 70 to practice the present invention. The weights 70, one of which is positioned on the rotary platform 10 illustrated in FIG. 1, are contemplated to be made from a material with a suitable density to establish a suitable inertia for the rotary platform. The weights 70 are contemplated to be made from materials such as iron, iron alloys, steel, steel alloys, lead, lead alloys, tungsten, tungsten alloys, and the like. Lighter materials also may be employed for the weights 70, especially if there is a desire to establish finer control (i.e., smaller weight increments) over the amount of total mass/weight that may be added to the rotary platform 10. The precise material from which the weights 70 are made is not considered to be critical to the operation of the exerciser ER.

As should be apparent to those skilled in the art, while the weights 70 are contemplated to be structurally identical from a top view, the weights 70 may differ from one another in mass. One weight 70 may have a mass of 1.0 kg, while another weight 70 may have a mass of, for example, 5.0 kg.

The exact masses of the individual weights 70 is not critical to the practice of the present invention.

Figure 2:
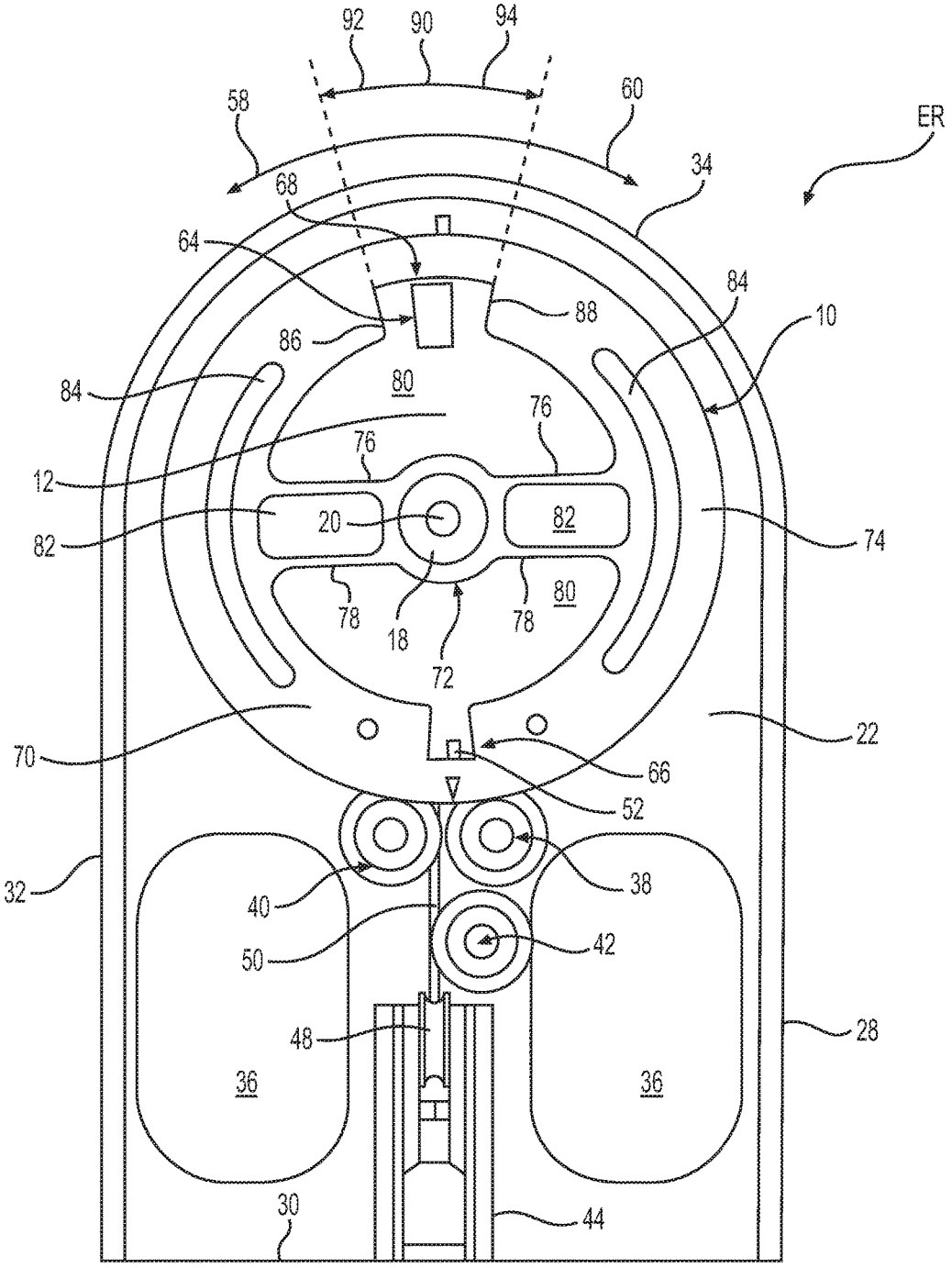
FIG. 2 is top view of the exerciser illustrated in FIG. 1, showing the weight in a first orientation.

FIG. 2 is a top view of the exerciser ER illustrated in FIG. 1. In this illustration, the weight 70 is disposed on the circular plate 12 such that the broad notch 68 engages the stop 64. This is the same orientation of the weight 70 that is illustrated in FIG. 1.

Figure 3:
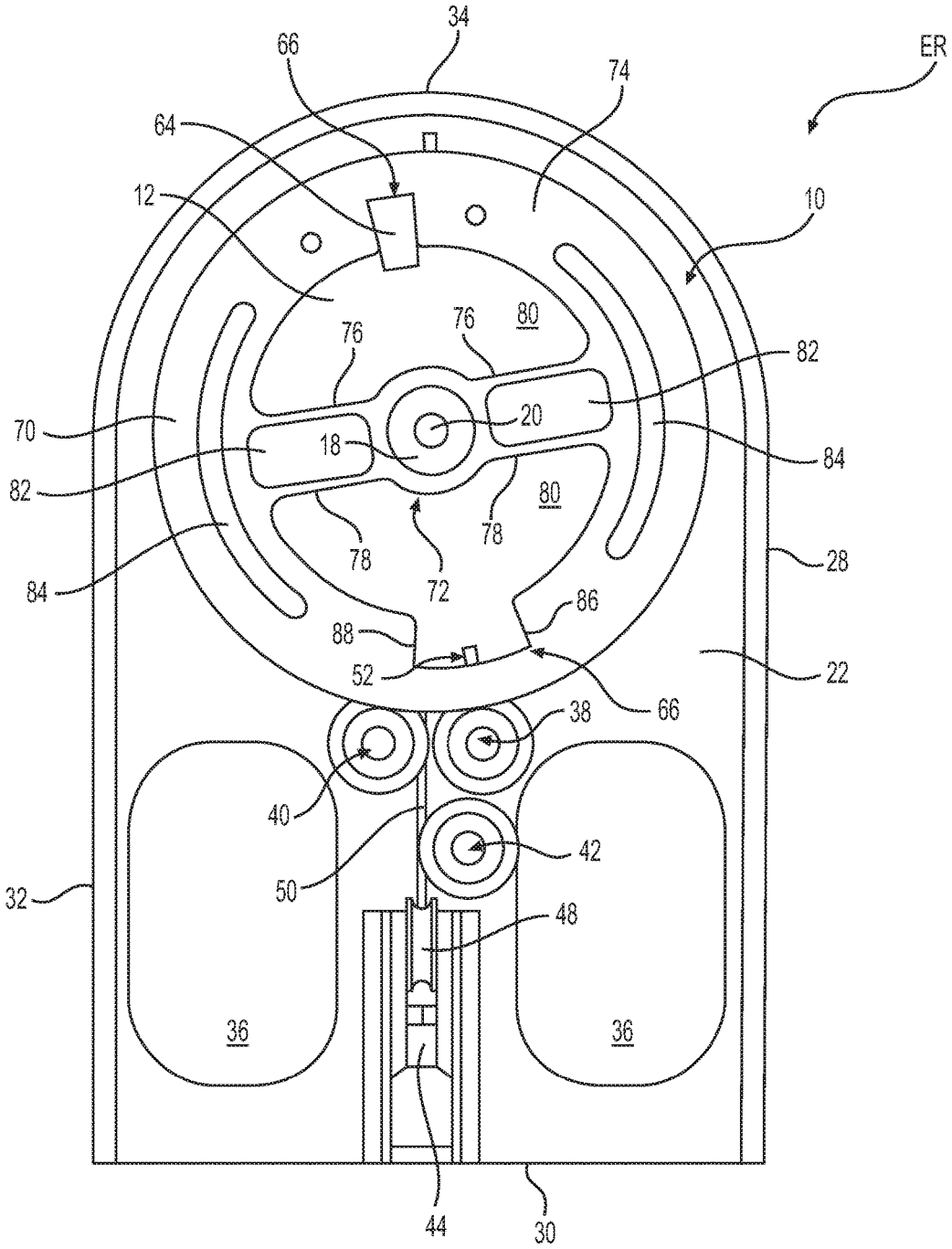
FIG. 3 is a top view of the exerciser illustrated in FIG. 1, showing the weight in a second orientation.
Figure 4:
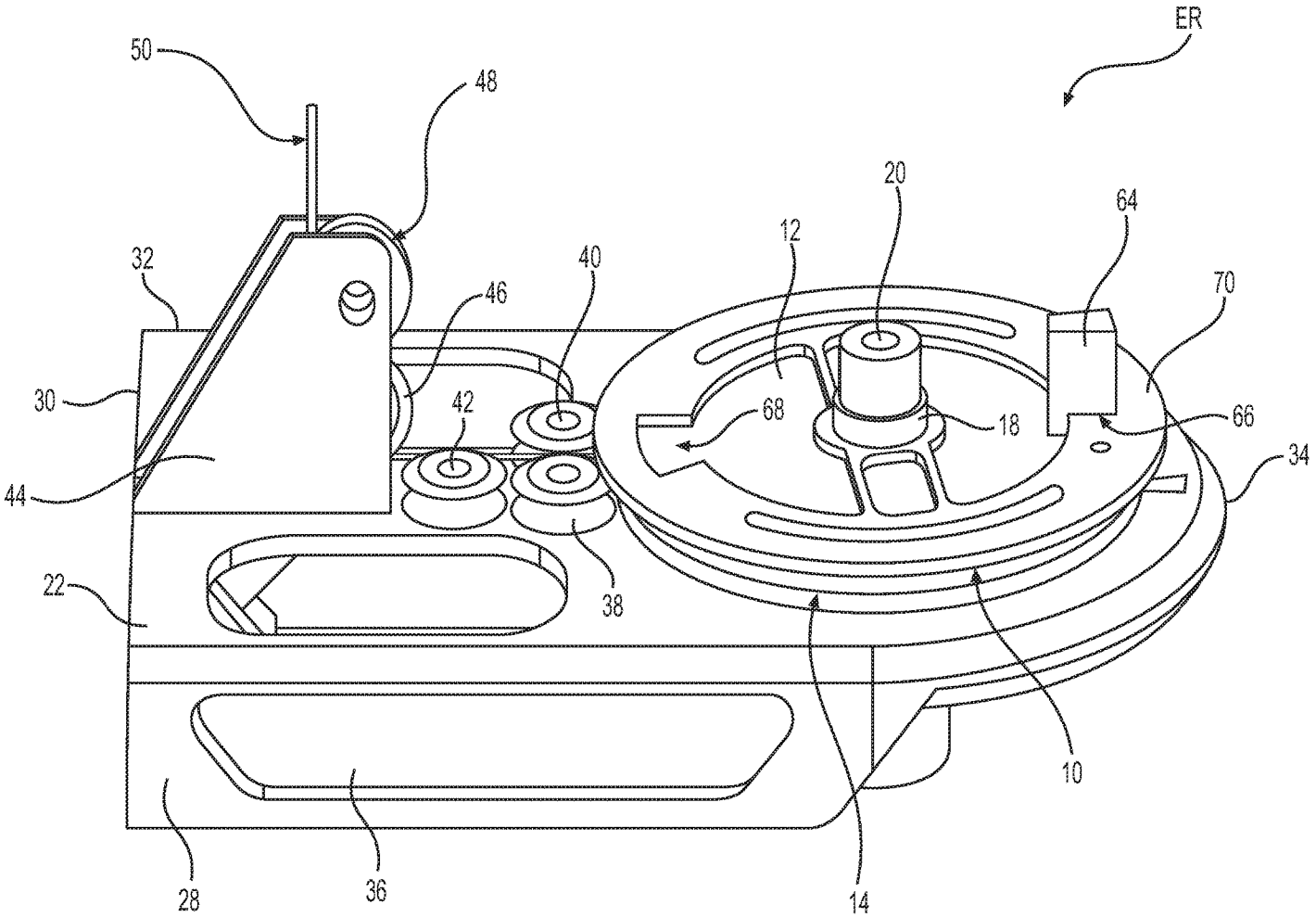
FIG. 4 is a perspective, side view of the exerciser as shown in FIG. 3.

Alternatively, it is contemplated that the weight 70 may be positioned on the circular plate 12 such that the narrow notch 66 engages the stop 64. This configuration is illustrated in FIGS. 3 and 4.

As illustrated in FIG. 2, the weight 70 is constructed to include an inner ring 72 and an outer ring 74. The inner ring 72 is connected to the outer ring 74 via a first pair of connectors 76 and a second pair of connectors 78. The inner ring 72 surrounds the hub 18 and/or shaft 20 so that the weight 70 may rotate around the axis defined by the hub 18 and the shaft 20.

As should be apparent to those skilled in the art, to maximize inertia for the rotary platform 10, it is preferred to distribute the mass of the weight 70 so that a majority of the mass persists at or near the perimeter of the weight 70. At least for this reason, the majority of the mass is distributed in the outer ring 74. Consistent with this approach, the weights 70 are contemplated to include two major holes 80 and two minor holes 82 between the inner ring 72 and the outer ring 74.

The outer ring 74 is contemplated to include one or more slots 84 therein. The slots 84 may be provided so that individual ones of the weights 70 may rotate with respect to other weights 70 stacked therewith. Alternatively, the slots 84 may be provided to permit weights 70 to engage one another in a non-sliding relationship, as required or as desired.

The construction of the weight 70 illustrated in the figures is a non-limiting example of one contemplated construction for the weight 70. The weight 70 may conform to any shape and follow any alternative construction without departing from the scope of the present invention.

As discussed in greater detail herein, the weights 70, once added to the circular plate 12, alter e inertia of the rotary platform 10, thereby adjusting the exercise parameters. There are two parameters for the exercise that may be adjusted. First, the amount of total mass added by the weights 70 may be adjusted simply be stacking the weights 70 on top of the circular plate 12. Second, the instantaneous force spike may be adjusted by selecting the amount of mass that is permitted to shift through the arc defined by the broad notch 68.

With respect to the first adjustable parameter, the total mass of the weights 70 may be altered by stacking a plurality of the weights 70 onto the circular platform 12. In one contemplated embodiment, the hub 18 may be removable from the circular plate 12. For example, the hub 18 may threadedly engage the circular plate 12, capturing the plurality of weights 70 between the hub 18 and the circular plate 12. Still further, the weights 70 may be affixed to the hub 18 and/or the circular plate 12 via magnets incorporated therein. Other fastening arrangements also may be employed without departing from the scope of the present invention.

The weights 70 may be stacked so that the weights 70 do not move rotationally with respect to the circular plate 12. In this arrangement, the narrow notches 66 of the weights engage the stop 64 on the circular plate 12. When the narrow notches 66 engage the stop 64, the weights 70 add to the inertia of the circular plate 12 without contributing to the instantaneous force spike associated with the broad notch 68, discussed in further detail below.

To generate the instantaneous force spikes at the termini (or maximum rotational points) of the rotation of the circular plate 12, the weights 70 are disposed on the circular plate 12 such that the broad notches 68 engage the stop 64. As such, when the circular plate 12 reaches a terminus (or maximum rotational point), the weights 70 are permitted to shift and, thereby, to generate an instantaneous force spike when one of the first edge 86 or the second edge 88 of the broad notch 68 impacts against the stop 64. FIG. 2 helps to illustrate this operation. As noted above, and as discussed in further detail below, the termini (or maximum rotational points) of the rotation of the circular plate 12 are adjustable by the user to accommodate several different types of exercise.

FIG. 2 includes the arrows 58, 60 that also are provided in FIG. 1. The arrows 58, 60 illustrate the rotational direction of the circular plate 12 when a person pulls on the tether 50 in the direction of the arrows 54, 56. When the rotary platform 10 reaches its maximum rotational point, as defined by the user, the rotary platform 10 stops.

When the rotary platform 10 stops, the weights 70 continue to rotate along a distance defined by the arc 90, which is shown in FIG. 2. Depending on the rotational direction of the rotary platform 10, the weights 70 will shift in the direction of one of the arrows 92, 94, which are also illustrated in FIG. 2. The instantaneous force spike is generated when the first edge 86 or the second edge 88 impacts the stop 64.

The rotary platform 10 rotated in either a clockwise or counterclockwise direction, consistent with arrows 58, 60, for a maximum travel of 360°. With a circular plate that is 12 inches in diameter (30.48 cm), the rotary platform 10 is contemplated to rotate through approximately 37 inches (93.98 cm) (360°) of travel, which means that approximately 37 inches (93.98 cm) of the tether 50 is available for exercise.

While a 12 inch (30.48 cm) rotary platform 10 is contemplated for the embodiment described herein, it is noted that the diameter of the rotary platform 10 may be changed without departing from the scope of the present invention. Similarly, while a 37 inch (93.98 cm) rotational travel distance is contemplated for a 12 inch (30.48 cm) diameter rotary platform 10, a larger or smaller travel distance may be employed without departing from the scope of the present invention.

In connection with the dimensions listed above, a 12 inch (30.48 cm) diameter circular plate 12 will have a circumference of approximately 113 inches (287.02 cm). A travel distance of 37 inches (93.98 cm), therefore, represents about 30% of the total circumference of the rotary platform 10. It is contemplated, therefore, for one exercise regimen, that the travel distance of the rotary platform 10 will be about 30% of the circumference of the rotary platform 10. This percentage may be altered so that the travel distance is ±2.5%), ±5% or ±10% of this value, as required or desired.

Still further, the present invention contemplates that the travel distance of the tether 50 may be altered as required or desired. For example, the travel distance of the tether 50 may be reduced by lessening the number of degrees that the rotary platform 10 is rotated prior to exercise. In one example, 90° of rotation will provide approximately 9 inches (22.86 cm) of travel distance of the tether 50. Nine inches (22.86 cm) of travel distance is approximately 8% of the circumference of a rotary platform with a diameter of 12 inches (30.48 cm). As before, this percentage may be altered so that the travel distance is ±2.5%, ±5%, or ±10% of this value, as required or desired.

As should be apparent, when the user pulls on the tether 50 in the direction of the arrow 54, the tether 50 pulls on the rotary platform 10, and the rotary platform 10 accelerates rotationally in the direction of, in this example, the arrow 58. When the engagement point 52 between the tether 50 and the circular plate 12 passes the guide pulleys 38, 40, 42, the kinetic energy of the rotary platform 10 pulls against the user in the direction of the arrow 60. The user must then decelerate the rotary platform 10 for the travel distance of about 37 inches (93.98 cm) to bring the rotary platform 10 to a halt. The exercise is then repeated when the user accelerates the rotary platform 10 in the opposite rotation, beginning the next repetition. Thus, the rotary platform 10 reciprocates clockwise and then counterclockwise, repetitively.

In the illustrated example, the acceleration and deceleration of the rotary platform 10 contributes to the development of at least one of muscle and/or bone mass. In this example, acceleration of the rotary platform 10 results in concentric muscle contraction until the engagement point 52 of the tether to the rotary platform 10 passes the guide pulleys 38, 40, 42. Once the engagement point 52 passes the guide pulleys 38, 40, 42, the user exerts force to decelerate the rotary platform 10, which continues in its clockwise rotation. The user's exertion results in an eccentric muscle contraction.

As noted above, any number of weights 70 may be added to the rotary platform 10 to increase the inertia of the rotary platform 10, and, therefore, increase the resistance presented to the user by the rotary platform 10. The weights 70 are designed to match the diameter of the rotary platform 10 such that the center of the mass of each weight 70 is concentric with the circular plate 12.

As discussed above, each weight 70 is contemplated to include two notches 66, 68 that engage the stop 64 on the rotary platform 10. As should be apparent, the weights 70 may include additional notches 66, 68, as required and/or desired, without departing from the scope of the present invention.

As noted above, FIGS. 1 and 2 illustrate the arrangement where the broad notch 68 on the weight 70 is aligned with the stop 64. As discussed above, with this construction, as the rotary platform 10 accelerates, the stop 64 on the rotary platform 10 engages either of the first edge 86 or the second edge 88 of the broad notch 68, which causes the weight 70 to travel together with the rotary platform 10. As the engagement point 52 on the rotary platform 10 passes the guide pulleys 38, 40, 42, the rotary platform 10 begins experiencing substantial deceleration. However, the weight 70, having been accelerated to its rotational speed by the rotary platform 10, continues to rotate in its accelerated direction 92, 94, irrespective of the movement of the rotary platform 10, until the opposite edge 86, 88 strikes the stop 64, causing the instantaneous force spike. This creates an instantaneous eccentric contraction on the user of the exerciser ER.

FIG. 3 is a top view of the exerciser ER, showing the weight 70 in the second orientation. As illustrated, the narrow notch 66 in the weight 70 engages the stop 64. Here, the weight 70 is fixed in relation to the stop 64. As a result, the weight 70 does not shift to create the instantaneous force spike. In this configuration, the weight 70 merely adds mass to the rotary platform 10 increase the inertia of the rotary platform 10.

FIG. 4 is a perspective, side view of the exerciser ER in the arrangement illustrated in FIG. 3. This perspective view provides an alternative perspective of the exerciser ER to further illustrate the features of this embodiment of the present invention.

Figure 5:
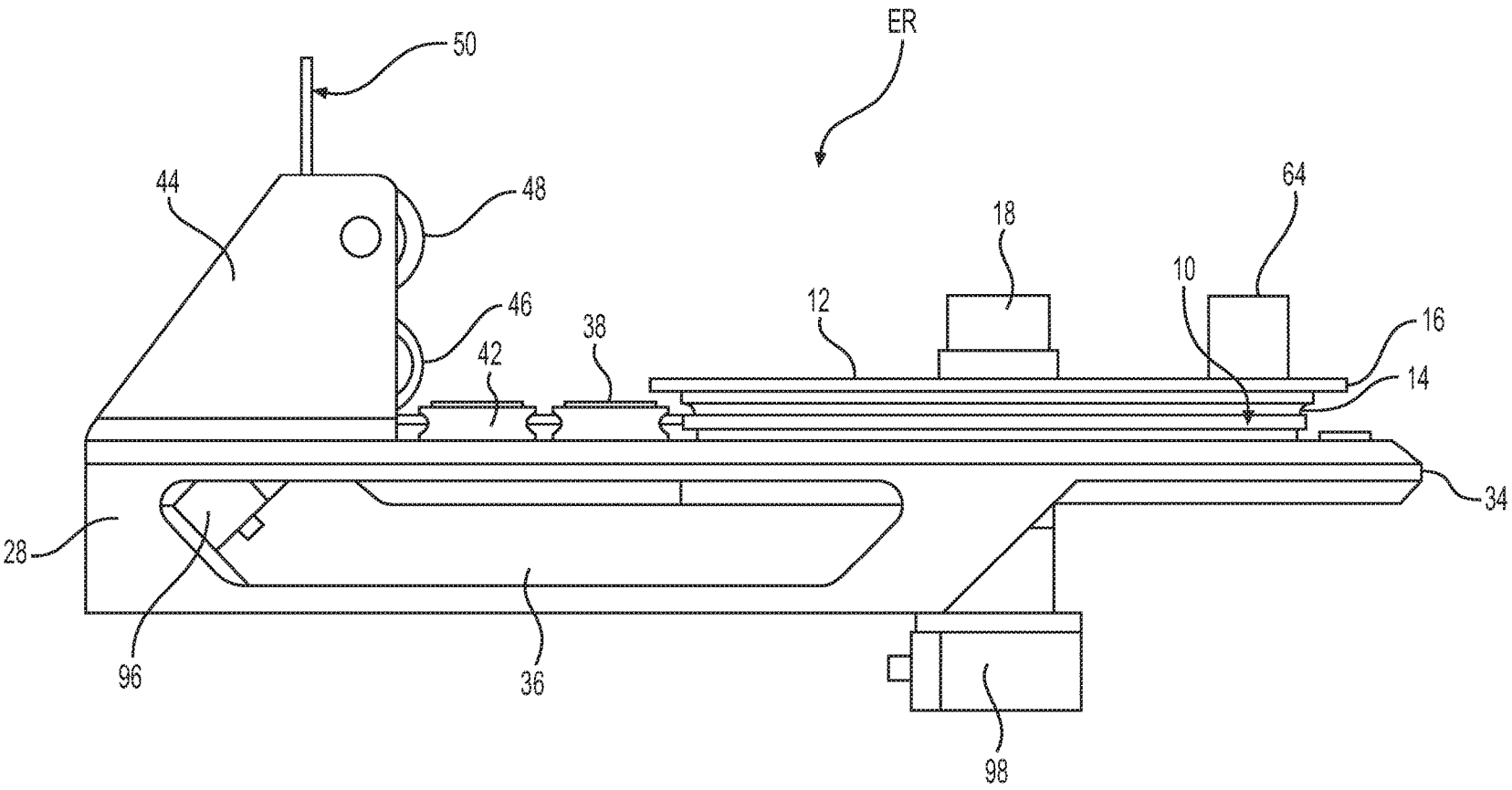
FIG. 5 is a side view of the exerciser shown in FIG. 1.

FIG. 5 is a side view of the exerciser ER illustrated in FIGS. 1-4. This side view illustrates further aspects of the exerciser ER. Specifically, as should be apparent to those skilled in the art, measuring the forces produced during exercise can be beneficial in tracking progress in developing proper training techniques. As a result, as shown in FIG. 5, the rigid frame 10 may be equipped with two measuring devices, a force sensor transducer 96 and a rotary sensor transducer 98. The force sensor transducer 96 is contemplated to be cooperate with one or more of the guide pulleys 38, 40, 42, 46, 48 to measure the absolute force on the tether 50 during the entire exercise. In the illustrated embodiment, the force sensor transducer 96 is connected to the fifth guide pulley 46. Measuring the work done during the exercise is accomplished by the rotary sensor transducer 98 connected to the shaft 20 to measure the rotation of the circular plate 12 in degrees. This measurement may be converted easily to a length of travel of the tether 50. As should be apparent to those skilled in the art, by measuring the force on the tether 50 and the rotation of the circular plate 12, it becomes possible to record and track the progress of the user from one exercise session to another.

Figure 6:
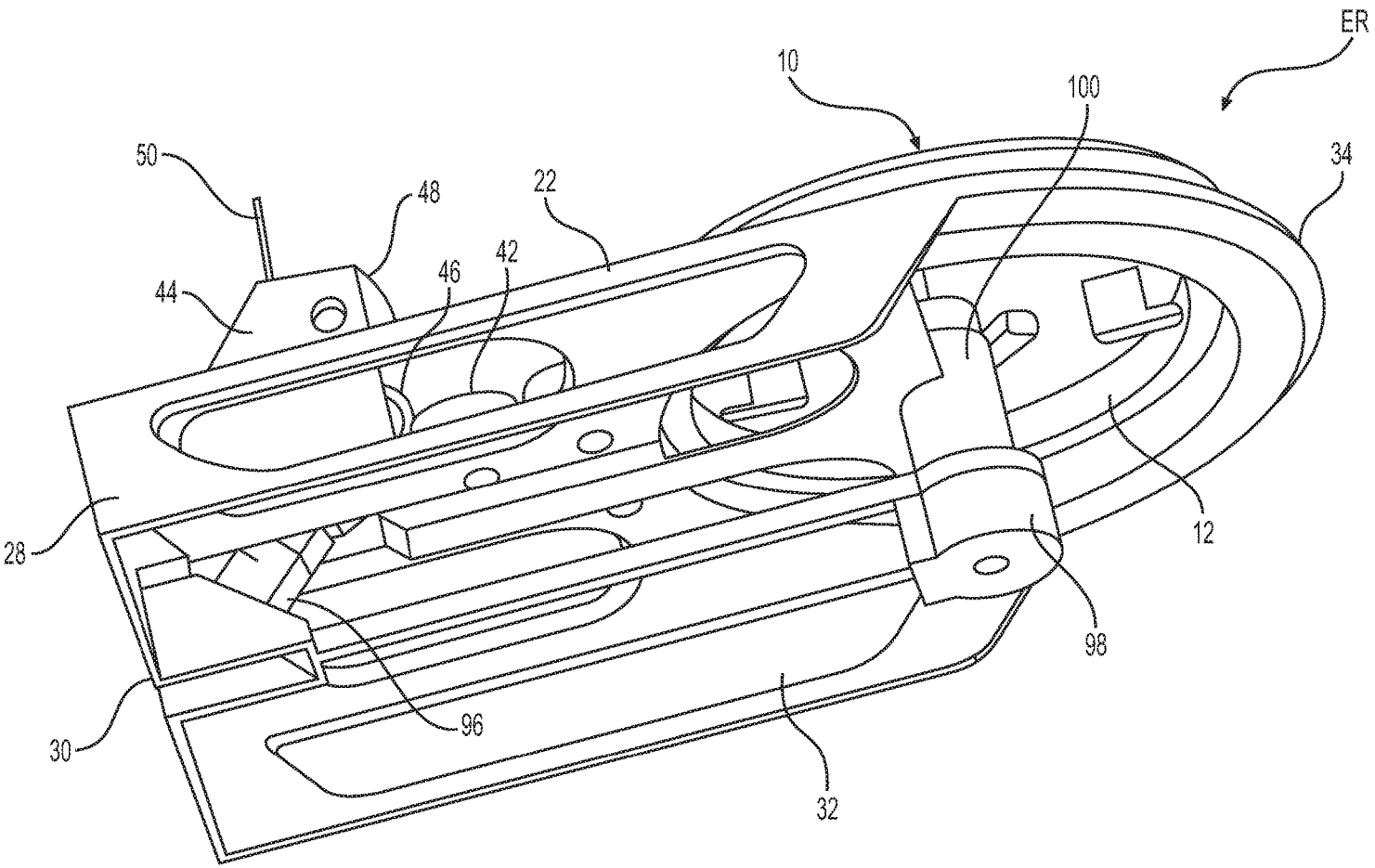
FIG. 6 is a perspective, bottom view of the exerciser illustrated in FIG. 1.

FIG. 6 is a perspective, bottom view of the exerciser ER illustrated in FIGS. 1-5. The positions of the force sensor transducer 96 and the rotary sensor transducer 98 are more clearly delineated in this illustration. In particular, the force sensor transducer 96 is attached to the bottom of the frame 22 at a location below the protrusion 44. It is contemplated that the force sensor transducer 96 will cooperate at least with the fifth guide pulley 46 to record the force on the tether 50. The rotary sensor transducer 98 is contemplated to be attached to a housing 100 that surrounds the shaft 20.

Figure 7:
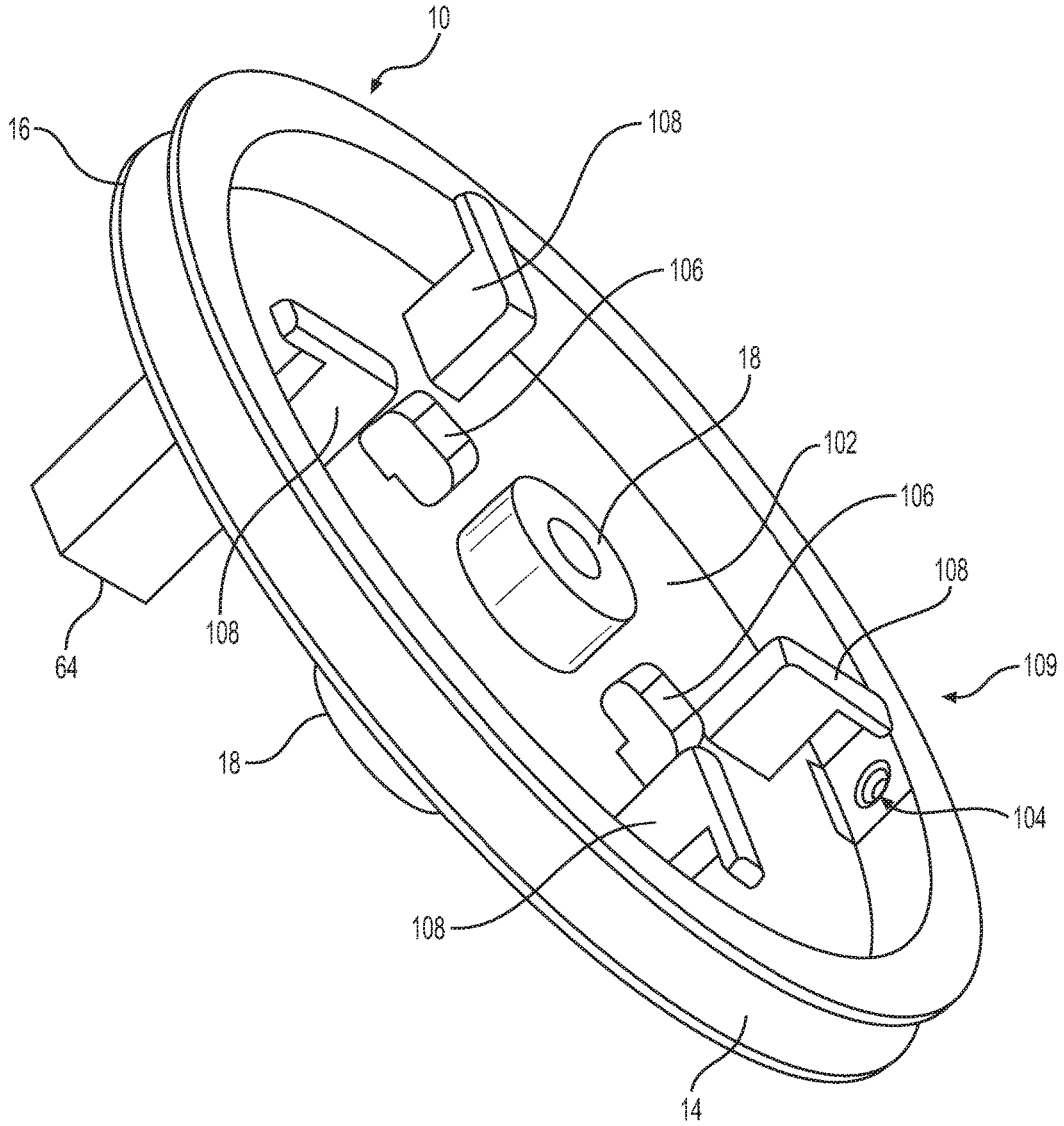
FIG. 7 is a perspective, bottom view of the rotary platform of the exerciser illustrated in FIG. 1.

FIG. 7 is a perspective, bottom view of the rotary platform 10 illustrated in FIGS. 1-5. The rotary platform 10 is constructed so that the length of the tether 50 may be adjusted as required and/or as desired for a particular exercise regimen. The bottom surface 102 includes the features permitting adjustment of the length of the tether 50.

As shown in FIG. 7, the circular plate 12 includes an entry hole 104 through which the tether 50 is threaded. In this embodiment, the entry hole 104 corresponds to the engagement point 52 of the tether 50 to the rotary platform 10, as discussed above.

The bottom surface 102 of the circular plate 12 is provided with two tether cinch tabs 106 and four tether collection tabs 108.

As illustrated in FIG. 7, the tether 50 is contemplated to be threaded through the entry hole 104, which is located 180° across from the stop 64. The length of the tether 50 may be shortened by pulling the tether 50 through the entry hole 104 and wrapping the tether 50 around the tether collection tabs 108. The tether 50 may then be cinched to one of the two tether cinch tabs 106. Together, the entry hole 104, tether collection tabs 108, and the tether cinch tabs 106 establish a tether length adjustment mechanism 109.

It is contemplated that the rotary platform 10 may be provided with any other suitable arrangement for shortening the tether 50 without departing from the scope of the present invention.

It is contemplated that the length of the tether 50 from the guide pulleys 38, 40, 43, 46, 48 to the user will be adjustable to accommodate exercise for upper and lower extremities.

The length of the tether 50 may be adjusted for other reasons, as required and/or desired. The length of the tether 50 defines the termini (or maximum rotational points) of the rotation of the circular plate 12 that is adjustable by the user.

The Second Embodiment: The Linear Platform

A second embodiment of the exerciser EL of the present invention is illustrated in FIGS. 8-15.

Figure 8:
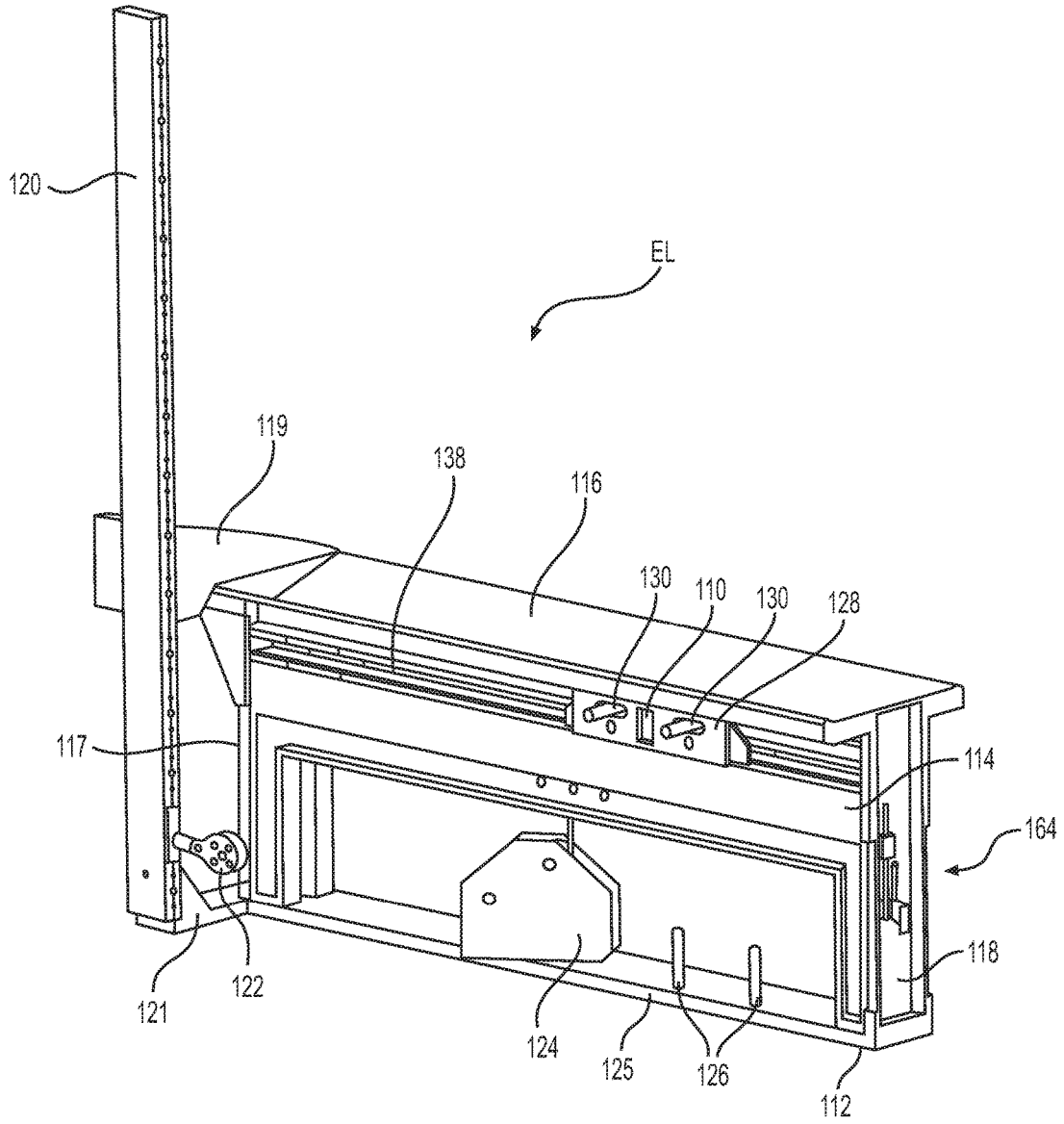
FIG. 8 is a perspective view of a second embodiment of an exerciser incorporating a linear platform for its operation.

Aspects of elements of the exerciser ER apply equally to the exerciser EL. For example, the materials for various components apply to the equivalent components that form the exerciser EL FIG. 8 is a perspective illustration of the exerciser EL, showing the overall construction for the exerciser EL.

According to the second embodiment of the present invention, the exerciser EL has a linear platform 110 that is slidably disposed on a frame 112. Here, the exerciser EL does not rely on rotary motion for acceleration, deceleration, and the generation of instantaneous force spikes, as discussed above in connection with the exerciser EL with the rotary platform 10.

As with the frame 22, the frame 112 may be made from any suitable material. Examples of suitable materials include, but are not limited to, lightweight materials, aluminum, aluminum alloys, magnesium, magnesium alloys, beryllium, beryllium alloys, titanium, titanium alloys, ceramics, composite materials, carbon fiber composites, plastics, and the like. Heavier materials also may be employed such as iron, alloys of iron, steel, brass, etc., as should be apparent to those skilled in the art.

In this second embodiment, the frame 112 includes two horizontal frame elements 114, 115 with a horizontal surface 116 supported on two vertical frame elements 117, 118. The horizontal frame elements 114, 115 and the vertical frame elements 117, 118 define a rectangle. A pulley frame element 120 is connected to the horizontal portion 114 by a first bracket 119 and to the vertical frame element 117 by a second bracket 121. The pulley frame element 120 includes a repositionable pulley 122 that may be moved to any position along the pulley frame element 120. The frame 112 also includes a guide pulley housing 124 attached to the horizontal frame element 115, which helps to guide the tether 50, as discussed in greater detail below. The horizontal frame element 115 also includes two posts 126 that function as a storage element for the weights 128 that are positionable on the linear platform 110. When disposed on the linear platform 110, the weights 128 are disposed on securements 130. In the illustrated embodiment, the securements 130 also are styled as posts.

Figure 9:
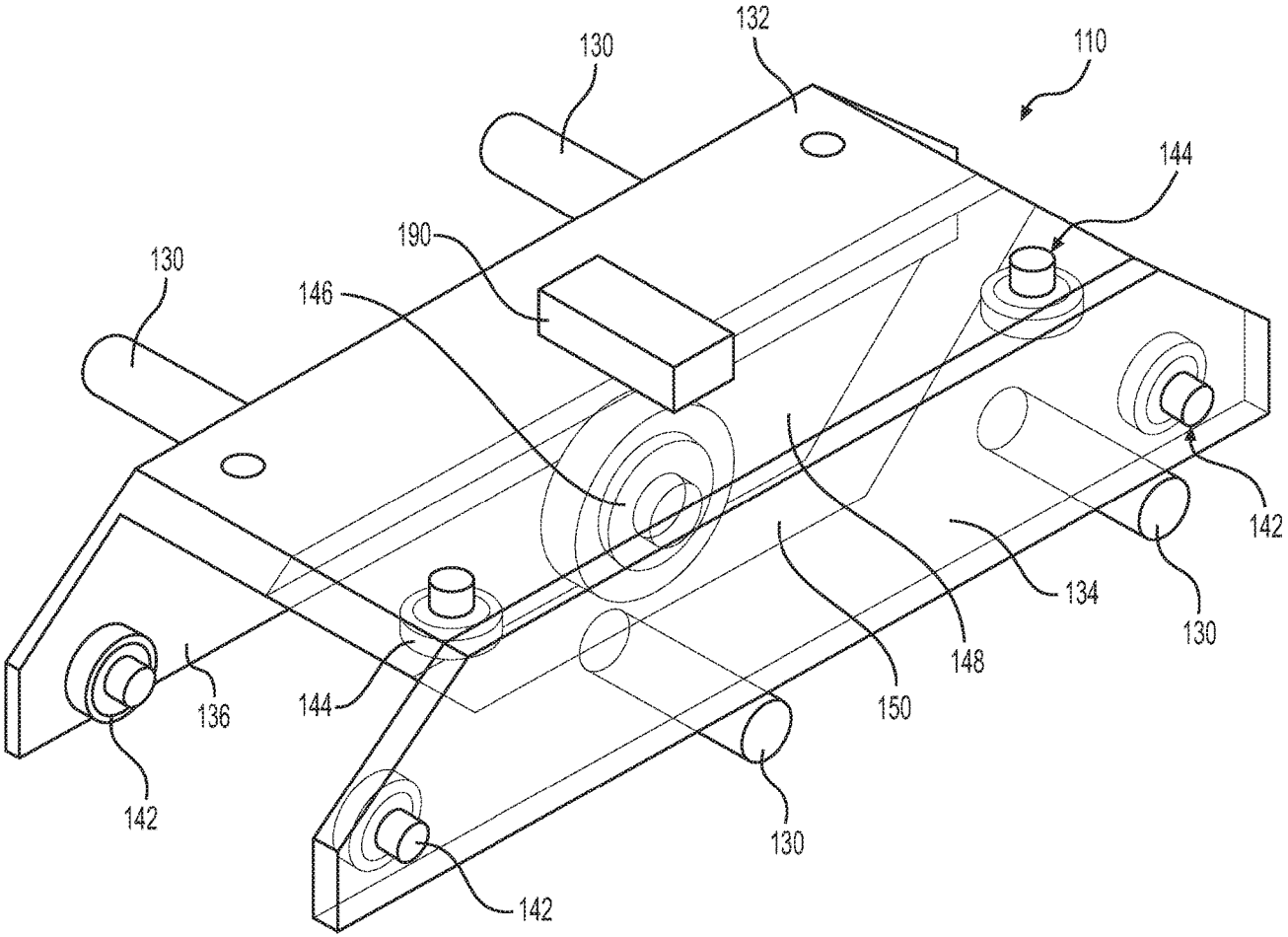
FIG. 9 is a perspective, top view of the linear platform of the exerciser illustrated in FIG. 8.

FIG. 9 is a perspective illustration of the linear platform 110. A portion of the linear platform 110 is illustrated in a skeletonized fashion to highlight the positional relationship between various components of the linear platform 110.

The linear platform 110 defines a sled with a top 132 and two, downwardly-extending sides 134, 136. The securements 130 extend outwardly from the sides 134, 136. As noted, the securements 130 support the weights 128 when the weights 128 are added to the linear platform 110.

The linear platform 110 may be made from any suitable material. Examples of suitable materials include, but are not limited to, lightweight materials, aluminum, aluminum alloys, magnesium, magnesium alloys, beryllium, beryllium alloys, titanium, titanium alloys, ceramics, composite materials, carbon fiber composites, plastics, and the like. Heavier materials also may be employed such as iron, alloys of iron, steel, brass, etc., as should be apparent to those skilled in the art.

Figure 10:
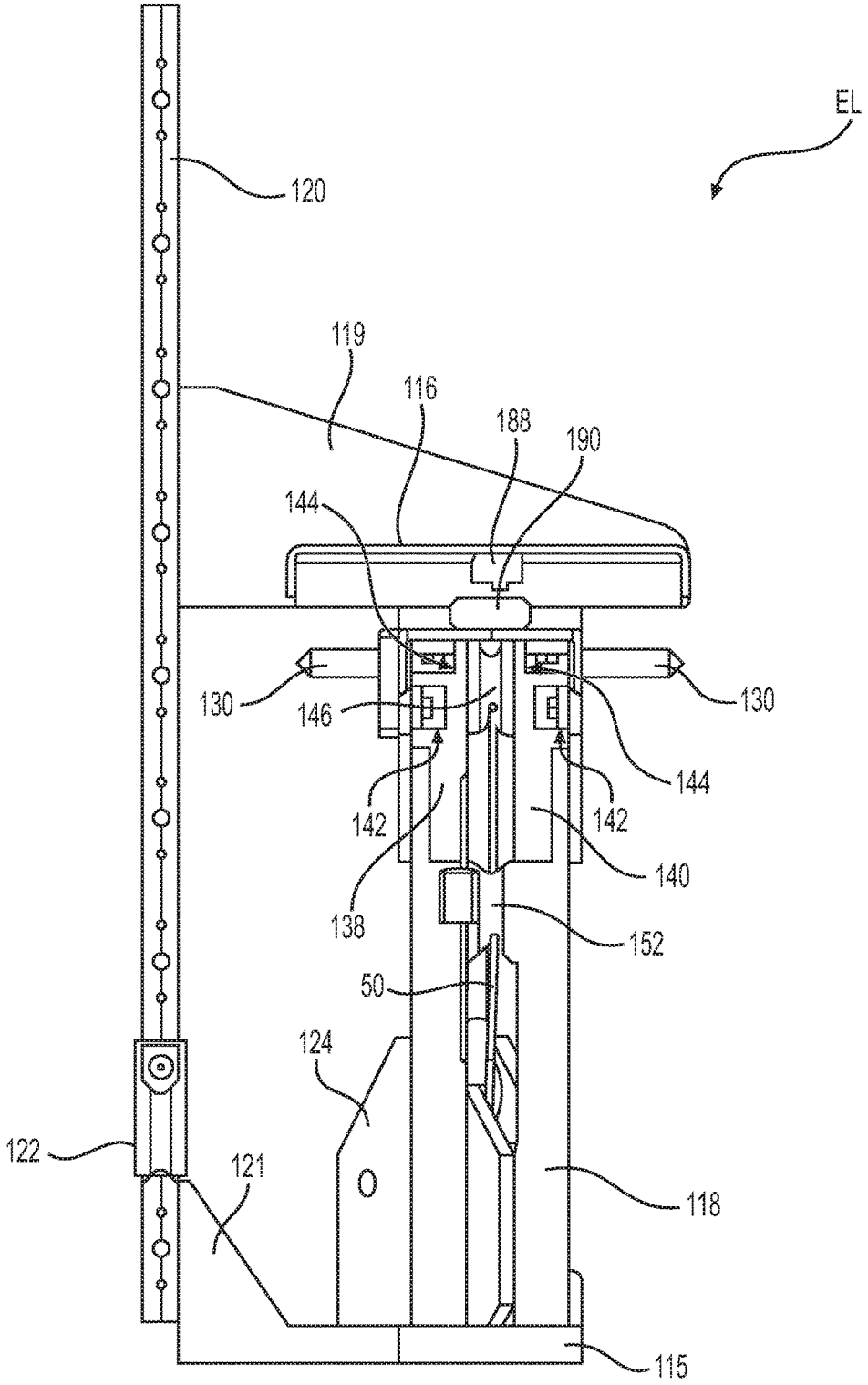
FIG. 10 is an end view of the exerciser illustrated in FIG. 8.

The linear platform 110 travels on one or more precision guide rails 138, 140. More specifically, the linear platform 110 includes a plurality of precision guide wheels 142, 144 so that the linear platform 110 may travel easily along two guide rails 138, 140, which are positioned in a side-by-side relationship to one another as illustrated in FIG. 10. The guide wheels 142 are oriented to rotate about horizontal axes. The guide wheels 144 rotate about vertical axes.

In the embodiment illustrated in FIG. 9, the linear platform 110 is contemplated to include a primary pulley 146 that is positioned under the top 132, between two supporting walls 148, 150. The tether 50 extends around the primary pulley 146. As discussed in greater detail below, the primary pulley 146 cooperates with the tether 50 so that the linear platform 110 travels on the guide rails 138, 140.

It is contemplated that the guide wheels 142, 144 on the linear platform 110 may include grooves that direct the linear platform 110 in a straight linear path, as illustrated in FIG. 10, for example.

In the illustrated embodiment, the guide rails 138, 140 are mounted to the frame 112. As in the previous embodiment, the linear platform 110 is accelerated by the tether 50, which is illustrated in FIG. 9. The tether 50 is contemplated to be connected at or near to the center of gravity of the linear platform 110, adjacent to one or more guide pulleys 152, 154, 156, 158, 160, 162, which are mounted at or near the center of the frame 112. The positions of the guide pulleys 152, 154, 156, 158, 160, 162 are illustrated in FIGS. 12 and 13.

Figure 12:
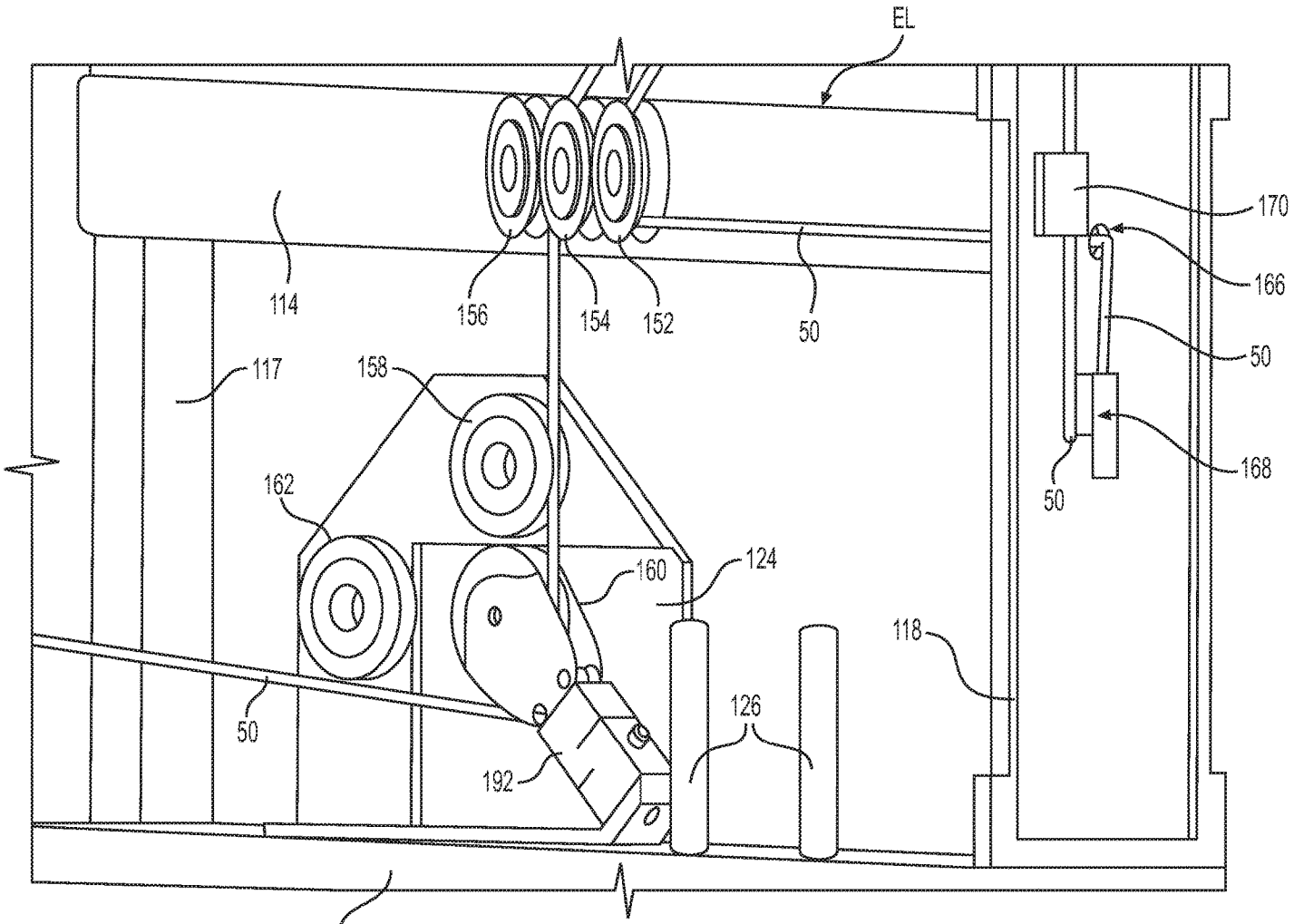
FIG. 12 is an enlarged, perspective side view of a portion of the exerciser illustrated in FIG. 8.
Figure 13:
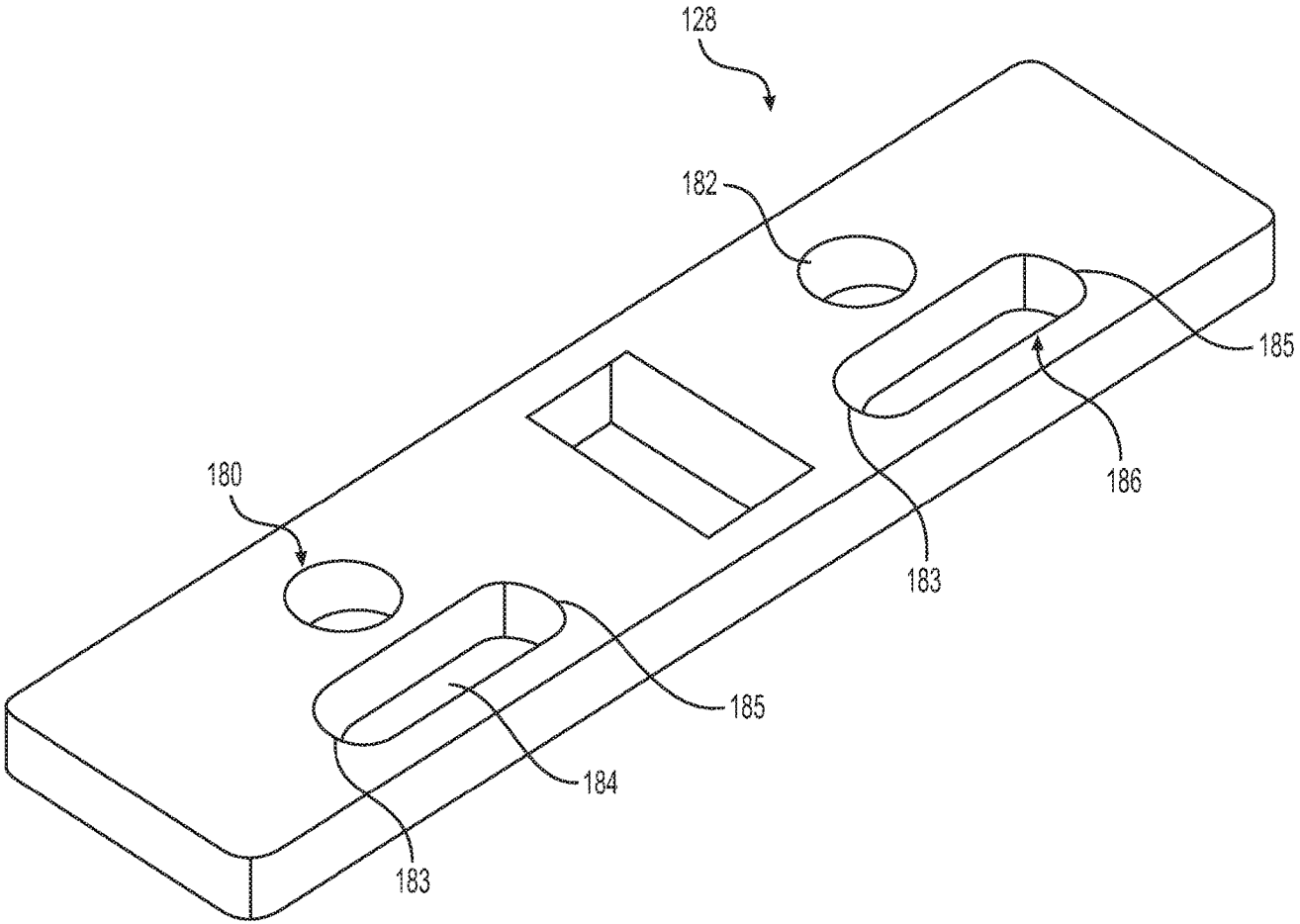
FIG. 13 is a perspective view of a weight employable with the exerciser illustrated in FIG. 8.
Figure 14:
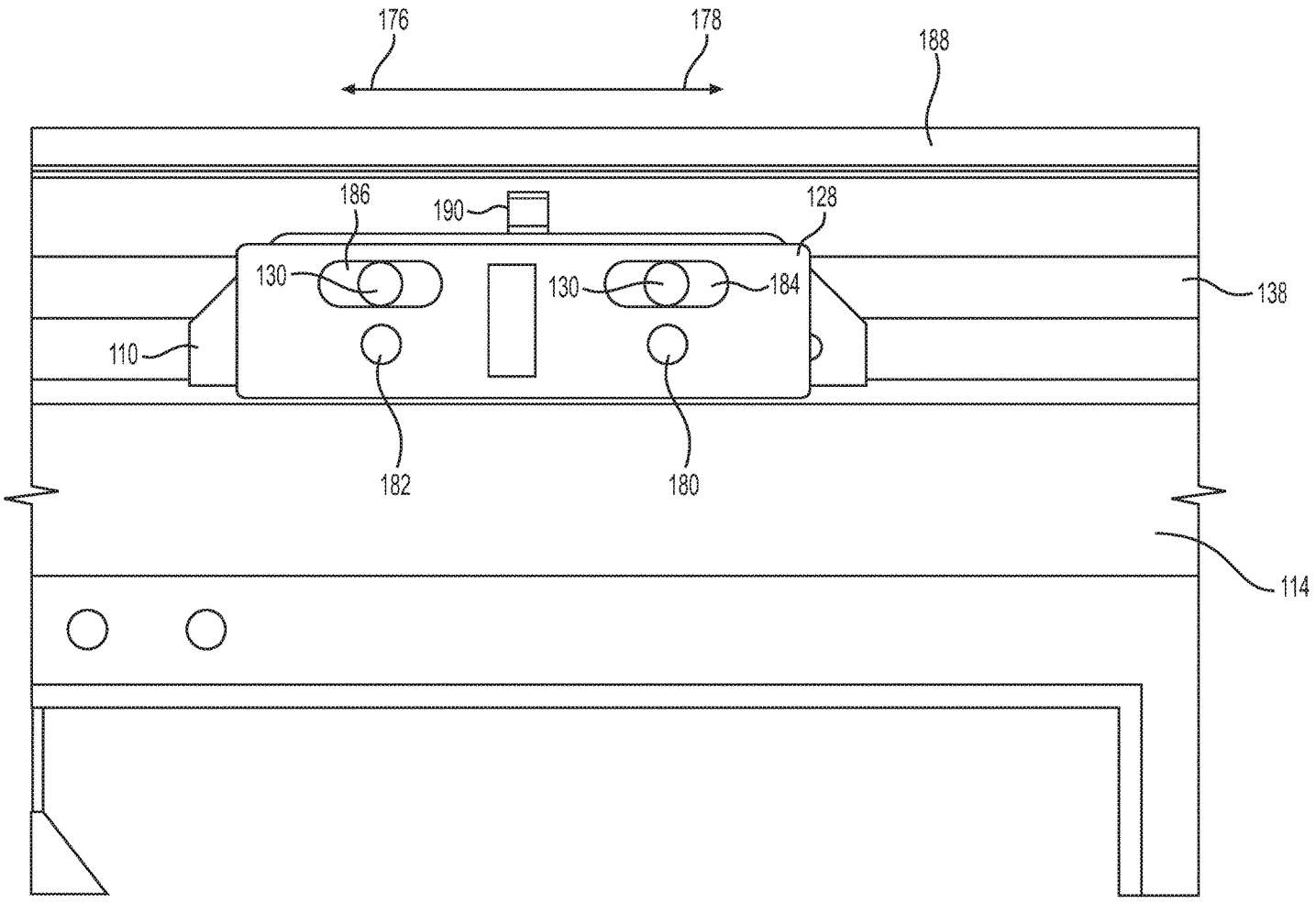
FIG. 14 is an enlarged, side view of a portion of the exerciser illustrated in FIG. 8, showing the weight in a first orientation.
Figure 15:
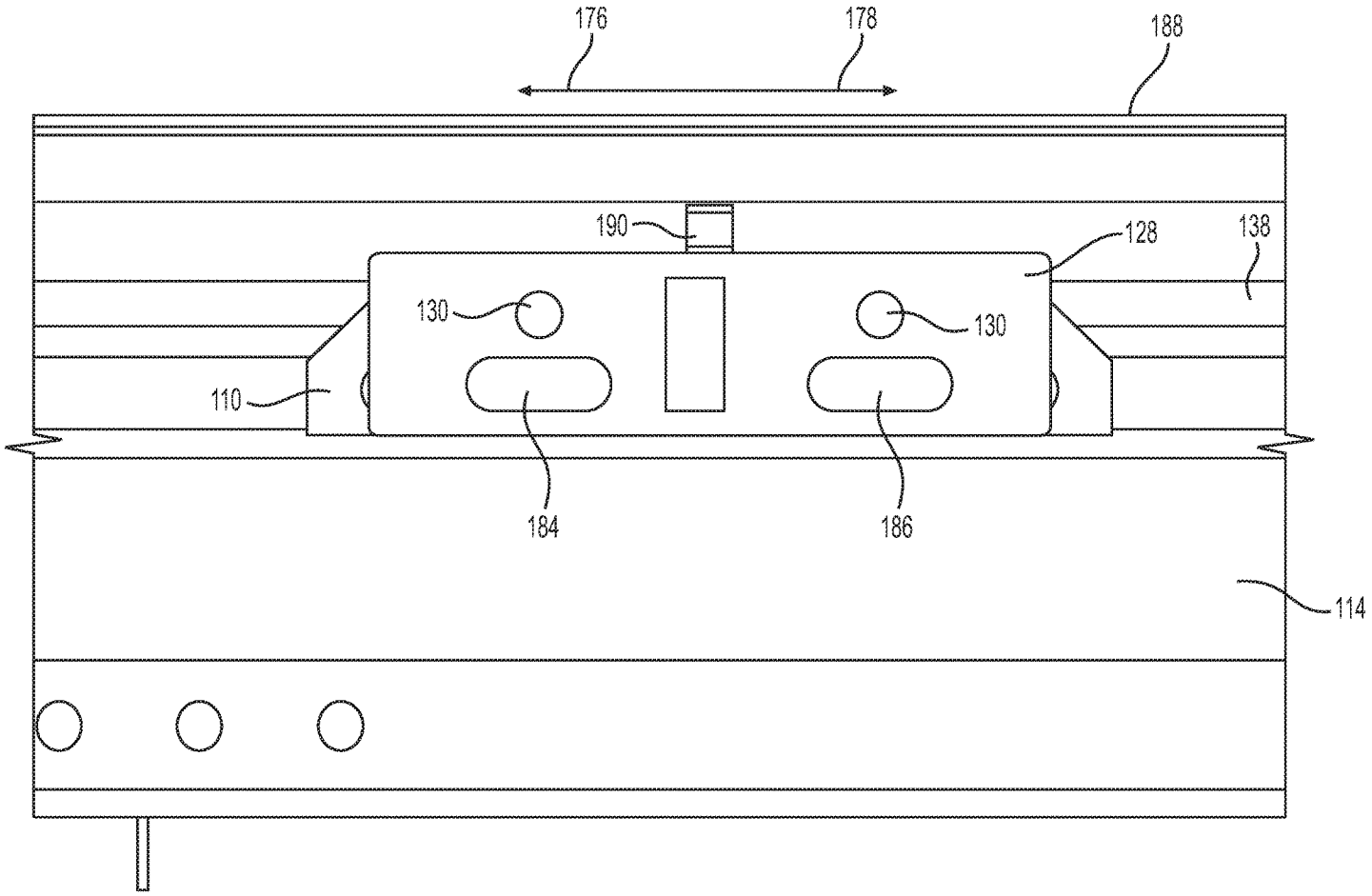
FIG. 15 is an enlarged, side view of a portion of the exerciser illustrated in FIG. 8, showing the weight in a second orientation.

The guide pulleys 152, 154, 156, 158, 160, 162 may be grouped in two groups, as shown in FIGS. 12 and 13. The guide pulleys 152, 154, 156 are horizontally grouped on the horizontal portion 114 of the frame 112. This first group of guide pulleys 152, 154, 156 guide the tether to the primary pulley 146 on the linear platform 110. The second group of guide pulleys 158, 160, 162 are grouped vertically within the guide pulley housing 124. The second group of guide pulleys 158, 160, 162 guide the tether 50 from the repositionable pulley 122 to the guide pulleys 152, 154, 156.

When the user pulls on the tether 50, the tether moves through the repositionable pulley 122 to the guide pulleys 158, 160, 162 at the base of the frame 112, The guide pulleys 158, 160, 162 direct the tether 50 so that the tether 50 is approximately 90° from its original orientation. The tether 50 continues to the guide pulleys 152, 154, 156 and, from there, to the primary pulley 146. from the primary pulley 146, the tether 50 continues back to guide pulleys 152, 154, 156, which directed tether to a tether adjustment mechanism 164.

The tether adjustment mechanism 164 permits adjustment of the length of the tether 50, just as in first embodiment. Here, the tether length adjustment mechanism 164 encompasses a hole 166 in the vertical frame element 118, a tether collection tab 168, and a tether cinch tab 170. The tether 50 may be wrapped around the collection tab 168 and secured by the tether cinch tab 170 to shorten the length of the tether 50.

As in the first embodiment, the exerciser EL may include a force sensor 192. In the illustrated embodiment, the force sensor 192 may be provided to measure one or more forces on the tether 50, just as in the previous embodiment.

Figure 11:
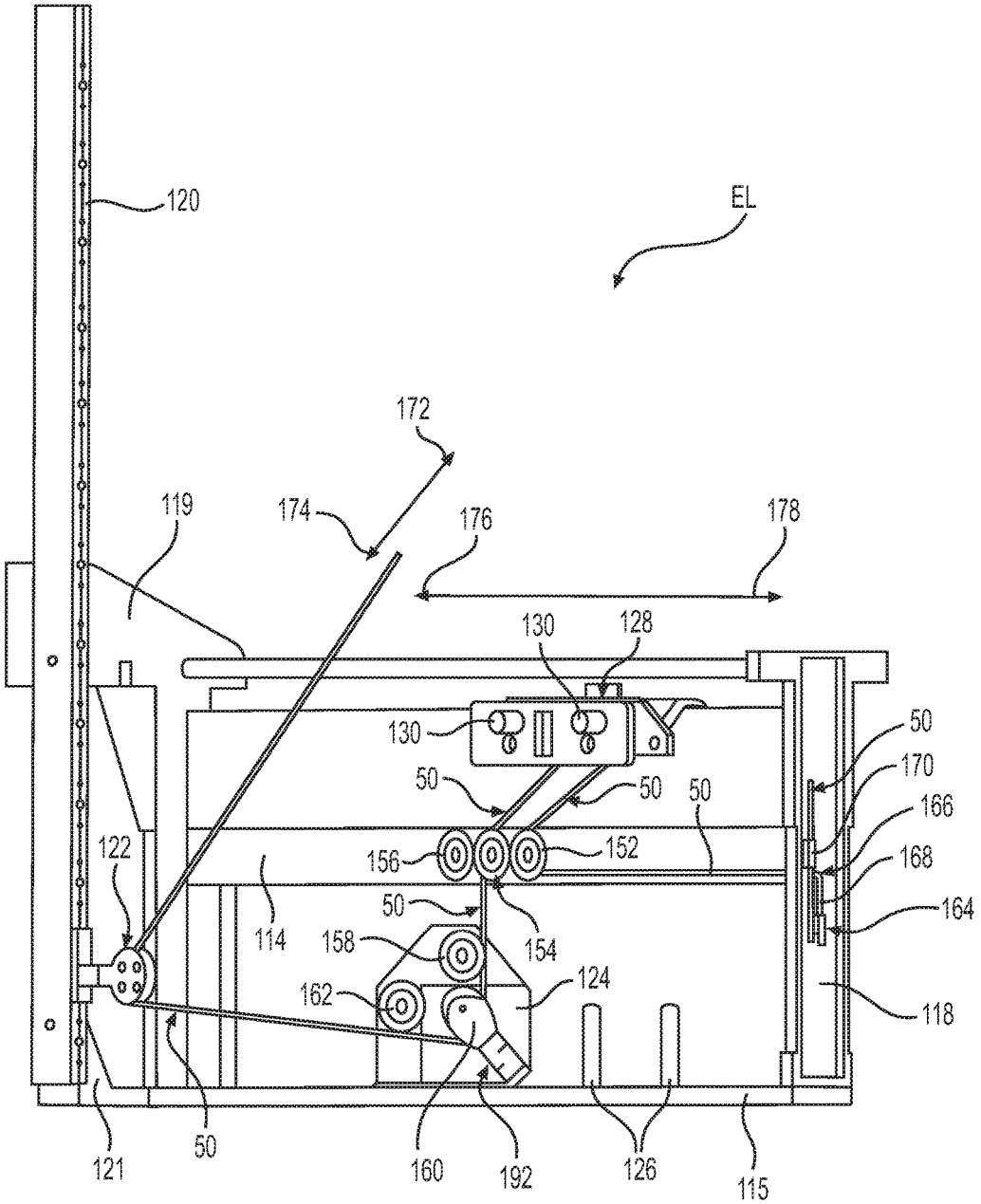
FIG. 11 is a perspective side view of the exerciser illustrated in FIG. 8.

FIGS. 11 and 12 illustrate, among other features, the guide configuration for the tether 50. As shown, the guide pulleys 152, 154, 156 are positioned in the center of the frame 112, on the horizontal frame element 114. The guide pulleys 152, 154, 156 guide the tether 50 to the primary pulley 146 on the linear platform 110. By pulling on the tether 50, the linear platform 110 is accelerated and then decelerated by the user, as before. Specifically, as the user pulls on the tether 50 in the direction of the arrows 172, 174, the linear platform 110 accelerates and decelerates in the direction of the arrows 176, 178.

As with the exerciser ER, weights 128 may be added to the linear platform 110. As with the weights 70, the weights 128 are contemplated to be made from materials such as iron, iron alloys, steel, steel alloys, lead, lead alloys, tungsten, tungsten alloys, and the like. Lighter materials also may be employed for the weights 128, especially if there is a desire to establish finer control (i.e., smaller weight increments) over the amount of total mass/weight that may be added to the linear platform 110. The precise material from which the weights 110 are made is not considered to be critical to the operation of the exerciser EL.

As in the prior embodiment, the weights 128 may be positioned on the securements 130 in one of two ways. First, the weights 128 include two holes 180, 182. The holes 182, 184 permit the weights 128 to be attached to the linear platform 110 so that the weights 128 do not shift when the linear platform 110 reaches the maximal travel termini in its travel direction along the guide rails 138, 140. The weights 128 also include two slots 184, 186. When the weights 128 are secured to the securements 130 via the slots 184, 186, the weights 12.8 may shift laterally when the linear platform 110 reaches the maximal travel termini, just as with the exerciser ER.

With the construction illustrated, when exercise is performed, the linear platform 110 shifts along the guide rails 138, 140 in relation to the guide pulleys 152, 154, 156. As the user pulls on the tether 50 in the direction of the arrow 172, the linear platform 110 moves in relation to the guide pulleys 152, 154, 156. Specifically, the linear platform 110 slides to the right and left of the guide pulleys 152, 154, 156, as illustrated in FIG. 12.

By pulling on the tether 50, the user accelerates the linear platform 110 to the right and left of the guide pulleys 152, 154, 156. At the maximal travel termini of the linear platform 110, the linear platform 110 decelerates to a stop. Thereafter, with continued effort by the user, the linear platform 110 accelerates toward the opposite travel terminus.

As before, the maximal travel termini of the linear platform 110 are defined by the user by adjusting the length of the tether 50 via the adjustment mechanism 164. This permits the user to set the maximum travel termini of the linear platform 110.

When the linear platform 110, together with the mass provided by the weights 128 moves past the guide pulleys 152, 154, 156, the inertia of the linear platform 110 reverses the direction of the tether 50, creating eccentric contraction and decelerating the linear platform 110. Eccentric contraction transitions to a concert contraction accelerating the linear platform 110 in the opposite direction toward the guide pulleys 152, 154, 156. Again, as the linear platform 110 passes the guide pulleys 152, 154, 156, the direction of the tether 50 reverses, causing another eccentric contraction.

As indicated, the weights 128 may be mounted to the linear platform 110, via the slots 184, 186, in a first orientation. The slots 184, 186 define first and second ends 183, 185. At the travel termini of the linear platform 110, the rapid deceleration of the linear platform 110 causes the inertia of the weights 128 to continue to slide until one end 183, 185 of the slots 184, 186 engages the securements 130, thereby causing an energy spike. The energy spike creates an instantaneous eccentric contraction on the user of the exerciser EL until the linear platform 110 decelerates to a halt. Eccentric contraction transitions into a concert contraction accelerating the linear platform 110 in the opposite direction toward the guide pulleys 152, 154, 156. Again, as the linear platform 110 passes the guide pulleys 152, 154, 156, the direction of the tether 50 reverses, causing another energy spike and eccentric contraction. As should be apparent, the securements 130 act as a stop, like the stop 64 provided on the rotary platform 10.

In a second orientation, the weights 128 are positioned on the securements via the holes 180, 182. In this second orientation, the weights 128 add to the mass of the linear platform 110 and, thereby, increase the inertia of the linear platform 110. As should be apparent, in this second orientation, the weights 128 do not shift to contribute to the instantaneous force spike.

It is contemplated that the frame 112 also will be equipped with a linear sensor transducer 188 disposed below the horizontal surface 116. A transducer magnet 190 is positioned on the linear platform 110. Together the linear sensor transducer 188 and transducer magnet 190 may measure the direction, speed, and distance of the linear platform 110 with great accuracy. In this way, the work done during each exercise session may be recorded and reported accurately.

The exerciser EL also is contemplated to include a force sensor transducer 192 connected to the guide pulley 160. The force sensor transducer 192 is contemplated to measure the force applied to the tether 50. As before, the forces sensor transducer is contemplated to generate data useable for monitoring the difficulty of the exercises performed with the exerciser EL.

As indicated above, the exerciser of the present invention may be implemented in any of a number of configurations without departing from the scope of the present invention. The equivalents and variations that should be apparent to those skilled in the art also are intended to be encompassed by the present invention.

What is claimed is:

1. An exerciser, comprising:

a frame;

a movable platform disposed on the frame, the movable platform being movable between a first position and a second position along a travel distance;

at least one mass disposable on the moveable platform in a first orientation so that the at least one mass slides between a third position and a fourth position along the travel distance; and a tether connected to the moveable platform to move the moveable platform from the first position to the second position, wherein the at least one mass slides to the third position when the movable platform decelerates to the first position, and wherein the at least one mass slides to the fourth position when the moveable platform decelerates to the second position.

2. The exerciser of claim 1, further comprising:

at least one stop disposed on the movable platform, wherein the at least one mass slidably engages the at least one stop at the third position and the fourth position.

3. The exerciser of claim 1, wherein the at least one mass generates an energy spike at the third position and at the fourth position.

4. The exerciser of claim 1, wherein the at least one mass is disposable on the movable platform in a second orientation so that the at least one mass remains unmovably fixed on the movable platform.

5. The exerciser of claim 1, further comprising a tether length adjustment mechanism permitting adjustment of a length of the tether.

6. The exerciser of claim 5, wherein the tether length adjustment mechanism comprises:

at least one tether collection tab, facilitating shortening of the tether; and at least one tether cinch tab, permitting securement of the tether in a shortened condition.

7. The exerciser of claim 1, further comprising:

a plurality of guide pulleys positioned adjacent to the movable platform to direct the tether to the movable platform.

8. The exerciser of claim 7, further comprising:

a force sensor transducer connected to at least one of the plurality of guide pulleys to generate data concerning a force applied to the tether.

9. The exerciser of claim 1, wherein the movable platform is a rotary platform.

10. The exerciser of claim 9, wherein the rotary platform comprises:

a circular plate, the circular plate being rotatable between the first position and the second position along the travel distance; and a groove defined at a perimeter of the circular plate, wherein the tether engages the groove.

11. The exerciser of claim 10, further comprising:

at least one stop disposed on a top surface of the circular plate, and a broad notch in the at least one mass defining first and second edges, wherein the first and second edges engage the at least one stop at the third position and the fourth position.

12. The exerciser of claim 11, wherein the at least one mass generates energy spikes at the third position and at the fourth position.

13. The exerciser of claim 10, wherein the at least one mass is disposable atop the circular plate in a second orientation so that the at least one mass remains unmovably fixed on the circular plate.

14. The exerciser of claim 1, wherein the movable platform is a linear platform.

15. The exerciser of claim 14, wherein the linear platform comprises:

a top and first and second sides; and a primary pulley secured between the first and second sides, wherein the tether engages the primary pulley.

16. The exerciser of claim 15, further comprising:

at least one stop disposed on each of the first and second sides, and at least one slot in the at least one mass defining first and second ends, wherein the first and second ends engage the at least one stop at the third position and the fourth position.

17. The exerciser of claim 16, wherein the at least one mass generates energy spikes at the third position and at the fourth position.

18. The exerciser of claim 15, wherein the at least one mass is disposable on one of the sides so that the at least one mass remains unmovably fixed on the linear platform.

19. The exerciser of claim 18, further comprising:

a vertical pulley frame element; and a repositionable pulley disposed on the vertical pulley frame element, wherein the tether engages the repositionable pulley.

* * * * *